US010056185B2

(12) United States Patent
Yamane et al.

(10) Patent No.: US 10,056,185 B2
(45) Date of Patent: Aug. 21, 2018

(54) IGNITION COIL REALIZING A CLOSED MAGNETIC CIRCUIT AND HIGHER EFFICIENCY

(71) Applicant: DIAMOND ELECTRIC MFG. CO., LTD., Osaka-shi, Osaka (JP)

(72) Inventors: Shinya Yamane, Osaka (JP); Masayuki Nishimura, Osaka (JP); Shuji Yamada, Osaka (JP); Daisuke Suzuki, Osaka (JP); Takuya Takaira, Osaka (JP); Hideaki Shimakawa, Osaka (JP)

(73) Assignee: DIAMOND ELECTRIC MFG. CO., LTD., Osaka-Shi, Osaka (JP)

( * ) Notice: Subject to any disclaimer, the term of this patent is extended or adjusted under 35 U.S.C. 154(b) by 216 days.

(21) Appl. No.: 14/783,682

(22) PCT Filed: Mar. 12, 2014

(86) PCT No.: PCT/JP2014/056486
§ 371 (c)(1),
(2) Date: Oct. 9, 2015

(87) PCT Pub. No.: WO2014/167931
PCT Pub. Date: Oct. 16, 2014

(65) Prior Publication Data

US 2016/0055966 A1 Feb. 25, 2016

(30) Foreign Application Priority Data

Apr. 10, 2013 (JP) ..... 2013-081803

(51) Int. Cl.
*H01F 38/12* (2006.01)
*H01F 27/32* (2006.01)
(Continued)

(52) U.S. Cl.
CPC ..... *H01F 38/12* (2013.01); *F02P 3/02* (2013.01); *H01F 27/022* (2013.01); *H01F 27/325* (2013.01); *H01F 27/40* (2013.01)

(58) Field of Classification Search
CPC .... F02P 3/02; F02P 15/00; F02P 19/02; F02P 19/021; F02P 19/028; F02P 3/0884;
(Continued)

(56) References Cited

U.S. PATENT DOCUMENTS 5,349,320 A * 9/1994 Suzuki ..... H01F 27/02 336/107
2009/0033452 A1* 2/2009 Akimoto ..... H01F 38/12 336/177
2009/0108972 A1* 4/2009 Wada ..... H01F 27/022 336/90

FOREIGN PATENT DOCUMENTS

EP 0617438 A1 9/1994
FR 2791806 A1 10/2000
(Continued)

OTHER PUBLICATIONS

European Search Report dated Nov. 18, 2016.
International Search Report, issued in PCT/JP2014/056485, dated Jul. 1, 2014.

*Primary Examiner* — Thienvu Tran
*Assistant Examiner* — Nicolas Bellido
(74) *Attorney, Agent, or Firm* — Birch, Stewart, Kolasch & Birch, LLP

(57) ABSTRACT

An ignition coil capable of maintaining reliable insulation performance over a long period of time. A coil main body unit, for housing a primary coil, a secondary coil and a switching element, includes a case main body in which a housing space is provided, and a case lower portion which abuts the perimeter of the case main body. The primary coil and the secondary coil, which are placed in the case lower
(Continued)

portion, are covered by the case main body. The secondary coil is configured by winding a second winding around a secondary bobbin, through which a central hole is extended in the horizontal direction, and the outer periphery of the same is covered by the case lower portion and a protective cap and is filled with a first material. When the primary coil is placed in the central hole, the remaining gap is filled with a secondary material.

7 Claims, 7 Drawing Sheets

(51) Int. Cl.
*H01F 27/40* (2006.01)
*H01F 27/02* (2006.01)
*F02P 3/02* (2006.01)

(58) Field of Classification Search
CPC .. F02P 9/002; F02P 7/035; F02P 1/083; F02P 3/0435; F02P 15/08; F02P 13/00; F02P 3/0453; F02P 3/051; F02P 3/0552; H01F 27/022; H01F 27/325; H01F 27/40; H01F 38/12; H01F 2038/122; F23Q 3/002; F23Q 2/285; B60R 21/0173; F02C 7/266; F42D 1/055; F02B 1/04; H01T 13/44
See application file for complete search history.

(56) References Cited

FOREIGN PATENT DOCUMENTS

| | | | | | |
|---|---|---|---|---|---|
| JP | 52-93425 | U | | 7/1977 | |
| JP | 9-260176 | A | | 10/1997 | |
| JP | 2001-23839 | A | | 1/2001 | |
| JP | 2001-23840 | A | | 1/2001 | |
| JP | 2001023839 | A | * | 1/2001 | ..... H01F 38/12 |
| JP | 2002-50528 | A | | 2/2002 | |
| JP | 3304315 | B2 | | 7/2002 | |
| JP | 2006-210374 | A | | 8/2006 | |
| JP | 2006-245425 | A | | 9/2006 | |
| JP | 2006245425 | A | | 9/2006 | |
| JP | 2009-182137 | A | | 8/2009 | |
| JP | 2009-295702 | A | | 12/2009 | |
| JP | 2012-69613 | A | | 4/2012 | |

* cited by examiner

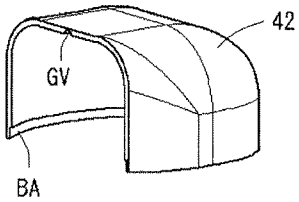
FIG. 1A PROTECTIVE CAP
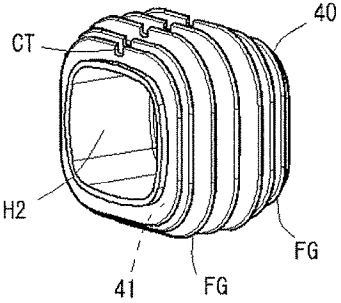
FIG. 1B SECONDARY COIL L2
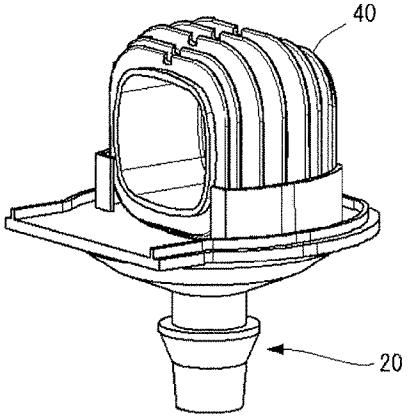
FIG. 1D PLACEMENT OF SECONDARY COIL L2
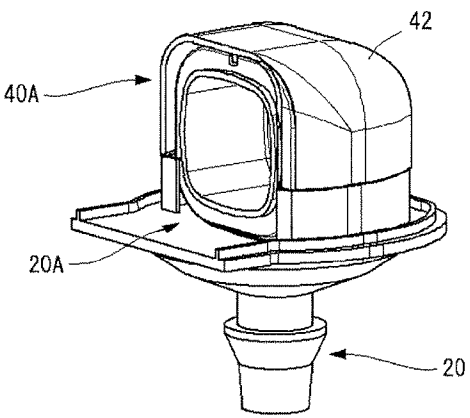
FIG. 1E ASSEMBLY OF SECONDARY COIL L2
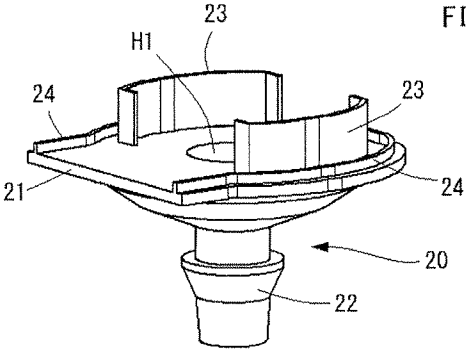
FIG. 1C CASE LOWER PORTION 20
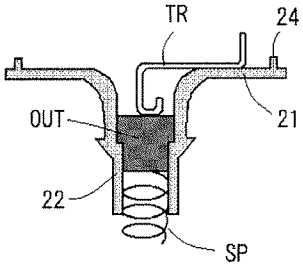
FIG. 1F HIGH-VOLTAGE TERMINAL AND CONDUCTIVE SPRING

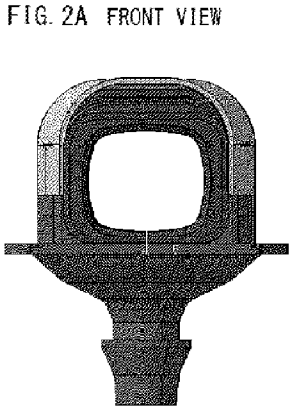
FIG. 2A FRONT VIEW
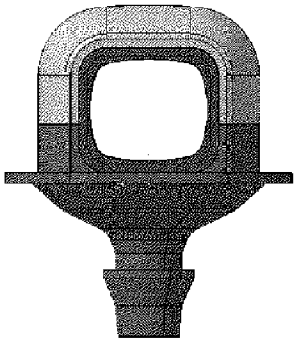
FIG. 2B REAR VIEW
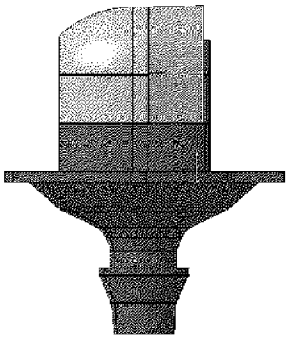
FIG. 2C SIDE VIEW
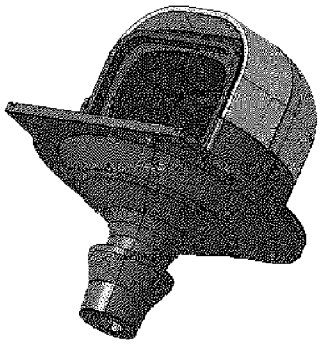
FIG. 2D
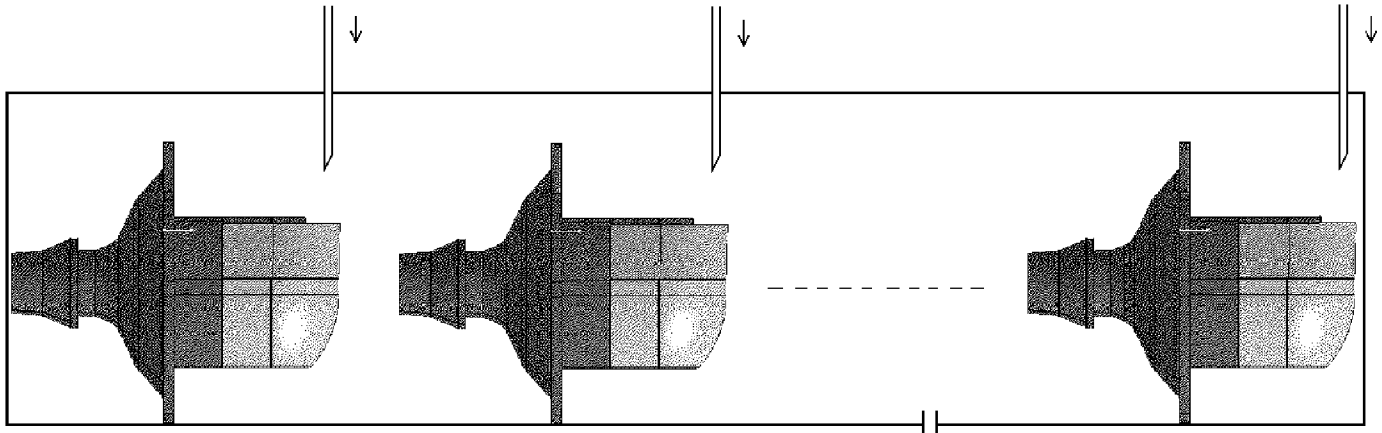
FIG. 2E WORK STATE OF PARTIAL IMPREGNATION

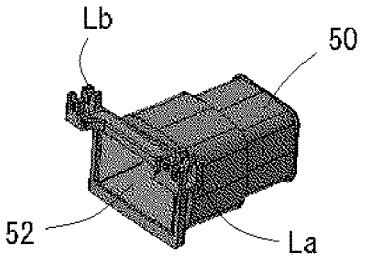
FIG. 3A PRIMARY COIL L1
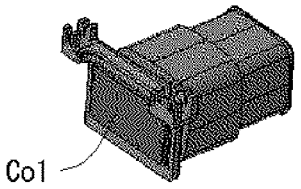
FIG. 3B
INSERT CENTER CORE Co1
FIG. 3C
PRIMARY COIL & CENTER CORE
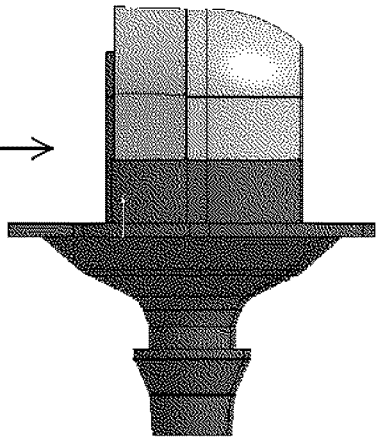
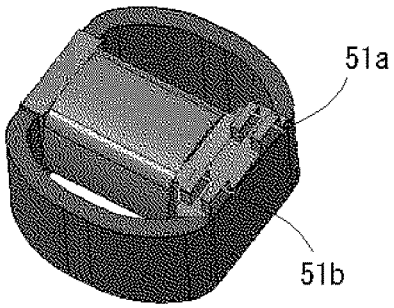
FIG. 3D
POSITION OUTSIDE CORE
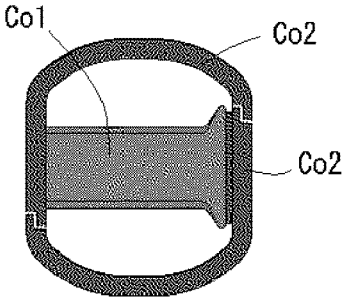
FIG. 3E
RELATIONSHIP BETWEEN
CENTER CORE AND OUTSIDE CORE FIG. 4A TERMINALS
Ta
CNa
t2
Tb
CNb
Td
CNd
Q5
Q4
Q3
Q1
Q2
FIG. 4B IGNITER Q
Hc
Ha
Hc
He1
He2
He3

HEAT SINK He
Ha
Tc
He4

GROUND TERMINAL
CNc

HEAT SINK
(MODIFIED EXAMPLE)
Hb
He'
Ha
Hb
Ha

FIG. 5A
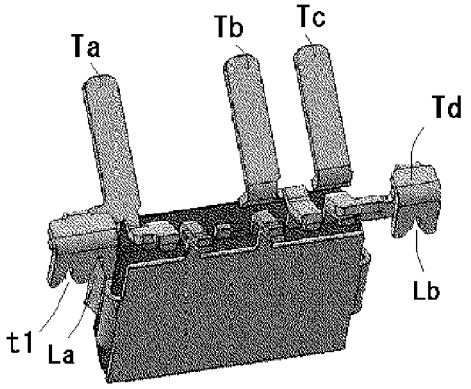
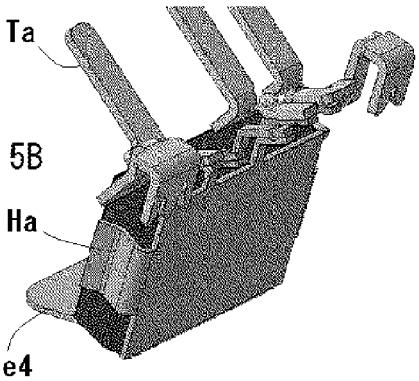
FIG. 5B
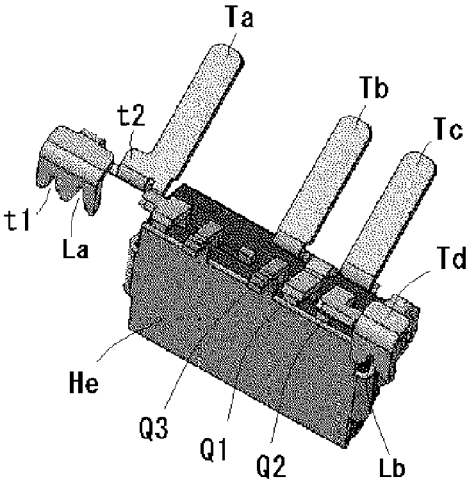
FIG. 5C DEV
FIG. 5D IGN
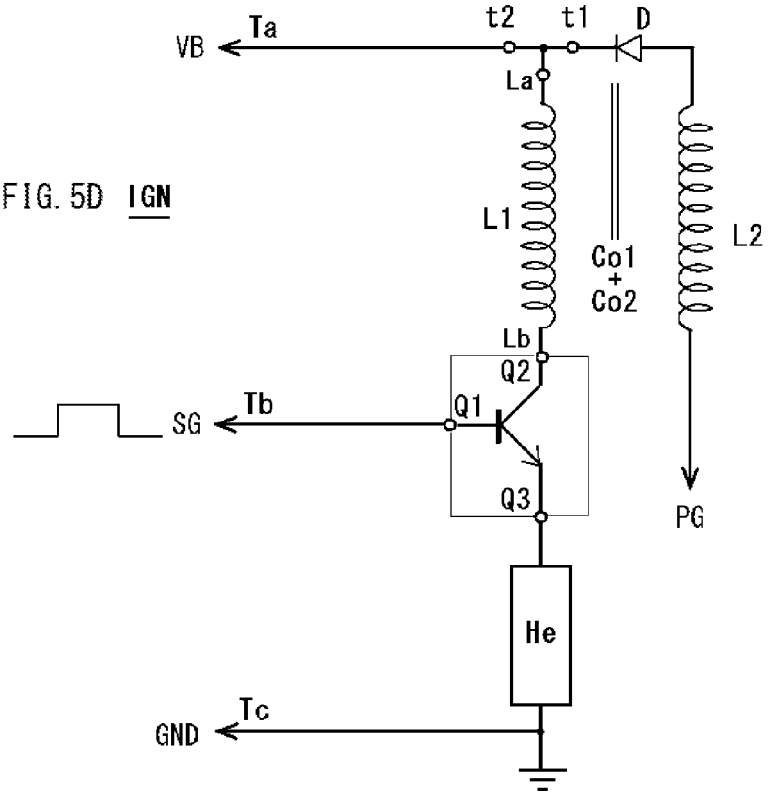

FIG. 6A
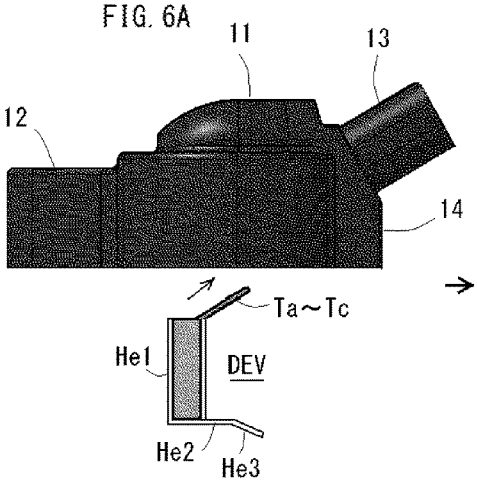
FIG. 6A'
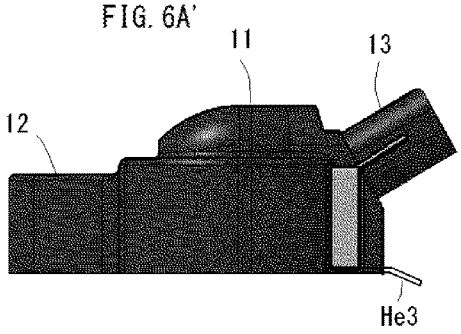
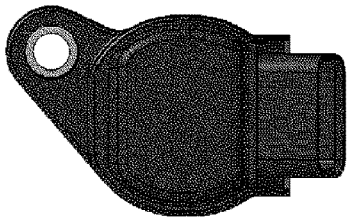
FIG. 6B
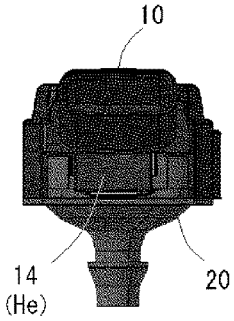
FIG. 6C
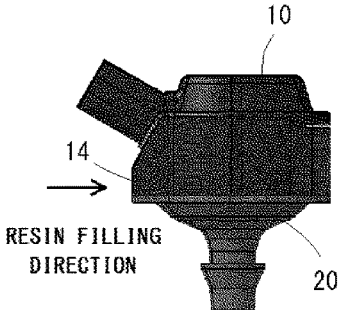
FIG. 6D
FIG. 6E
COMPLETED STATE OF IGNITION COIL 1
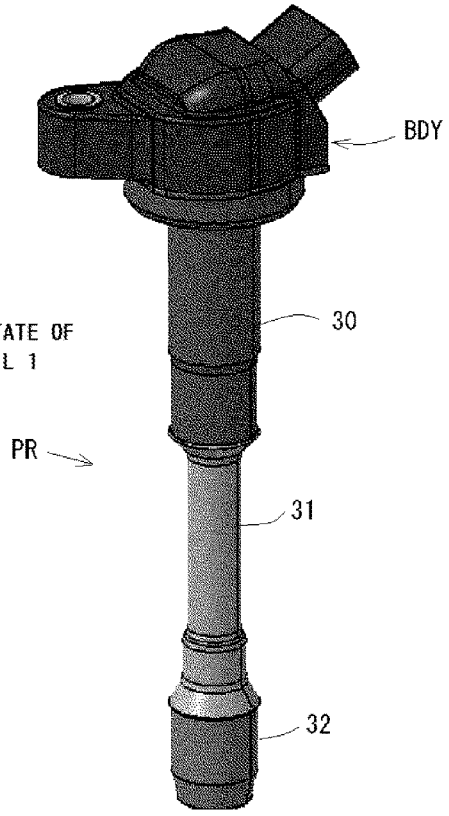

IGNITION COIL REALIZING A CLOSED MAGNETIC CIRCUIT AND HIGHER EFFICIENCY

TECHNICAL FIELD

The present invention relates to an ignition coil employed for an internal combustion engine, and particularly to an ignition coil realizing a closed magnetic circuit and higher efficiency.

BACKGROUND ART

A typical ignition coil generally has a substantially T shape configured by a projecting shaft unit inserted into a plug hole, and a base end unit positioned above the plug hole. These units are integrated into one piece body.

According to a so-called pencil type ignition coil, the projecting shaft unit is provided with a primary coil having a cylindrical shape to house a center core, and a secondary coil disposed coaxially with the primary coil (Patent Document 1 and Patent Document 2).

In this configuration, however, a closed magnetic circuit structure is formed in correspondence with the cylindrical center core. Accordingly, coil output and power efficiency are limited.

PRIOR ART DOCUMENTS

Patent Documents

[Patent Document 1] JP2001-23840A
[Patent Document 2] JP2002-50528A

DISCLOSURE OF THE INVENTION

Problems to be Solved by the Invention

One of possible solutions to these problems is to provide the primary coil and the secondary coil on the base end unit to form a closed magnetic circuit thereon. According to this configuration, however, all of the primary coil, the secondary coil, and an ignition circuit need to be disposed on the base end unit exposed from the plug hole. In this case, the entire size of the ignition coil becomes larger than the size of the pencil type ignition coil. In addition, there is a demand for a configuration capable of maintaining reliable insulation performance of the secondary coil over a long period without increasing manufacturing costs.

The present invention has been made in view of the above problems and an object thereof is to provide an ignition coil capable of outputting necessary ignition energy with high efficiency without increasing manufacturing costs. Another object of the present invention is to provide an ignition coil capable of maintaining reliable insulation performance over a long period.

Means for Solving the Problems

For achieving the above objects, the present invention is directed to an ignition coil comprising: a coil main body unit that houses a primary coil and a secondary coil electromagnetically coupled with each other, and a switching element that controls on-off of a current of the primary coil; and a projecting shaft unit that projects in a first direction from the coil main body unit. The coil main body unit is segmented into a case main body having a housing space, and a case lower portion abutting a perimeter of the case main body, in which condition the primary coil and the secondary coil disposed on the case lower portion are covered by the case main body. The secondary coil is formed by winding a secondary winding around a secondary bobbin that includes a central hole penetrating the secondary bobbin in a second direction substantially perpendicular to a first direction, while an outer periphery of the secondary coil in the second direction is filled with a first insulation material in a state that the outer periphery of the secondary coil in the second direction is covered by the case lower portion and a protective cap. A gap remaining in the case lower portion and the case main body is filled with a second insulation material in a state that the primary coil is disposed in the central hole.

According to the present invention, the outer periphery of the second coil in the second direction is filled with the first insulation material in a state that the outer periphery of the second coil in the second direction is covered by the case lower portion and the protective cap. In this case, the insulation performance of the secondary coil is secured by the protective cap and the first material, therefore reliable insulation performance can be maintained over a long period by selecting appropriate materials for the protective cap and the first material. Examples of the selection parameters include adhesiveness between the first material and the secondary winding, a similarity in thermal expansion coefficients between the first material and the secondary winding, and an affinity between the first material and the protective cap. A large amount of the first material is not required, therefore the manufacturing costs do not increase even when the optimum material is used for the first material.

According to the present invention, it is not particularly prohibited that the first material and the second material are constituted by identical materials. It is preferable, however, that the properties of the first material and the second material are different from each other in electric insulation and/or thermal conductivity. The insulation performance of the secondary coil is secured by the first material, while the second material is used for the purpose of filling the primary coil and surroundings of a magnetic core forming an appropriate magnetic path. Accordingly, an appropriate material needs to be selected for the second material. In consideration of the manufacturing costs, it is preferable that less expensive material than the first material is selected for the second material. However, in consideration of radiation performance, a material having excellent thermal conductivity should be selected for the second material.

In consideration of a process for injecting the first material, it is preferable that a plurality of sectioning flanges are provided on the secondary bobbin at positions separated from each other in the second direction, in which condition the secondary winding is wound between the sectioning flanges. In this case, each of the sectioning flanges includes a notch which serves as an injection path for the first material. It is further preferable that a cutout groove is formed in an inner periphery of the protective cap in correspondence with the notches.

For meeting a demand for size reduction, it is preferable that the secondary bobbin has not a uniform external size in the second direction, but a flared or barrel-like rounded shape. In this case, it is preferable, for injection of the first material, that an inside diameter size of the protective cap is determined such that a rounded shape is formed in the second direction in correspondence with the external size of the secondary bobbin, with the base end side of the secondary bobbin closed by the protective cap by abutment between the base end side of the secondary bobbin and the protective cap, and with the tip side of the secondary bobbin opened through a gap between the tip end side of the secondary bobbin and an inner surface of the protective cap. It is preferable that the first material is constituted by a thermosetting resin. Accordingly, it is preferable in this case that an inside heating condition is realized by energization of the secondary winding after injection of the first material.

It is preferable that the protective cap is integrated with the case lower portion by welding in a state that the protective cap covers the secondary coil.

A method for injecting the second material may be an arbitrary method. It is preferable, however, that the case lower portion, to which the primary and secondary coils and the protective cap are fixed, is sunk into the case main body that has the housing space opened upward, in a state that the case main body is filled with an appropriate amount of the second material, to fill the gap of the housing space. A small gap has been already filled with the first material, therefore the second material may be filled by this overflow method. In this case, working efficiency increases when the case main body has a receiving space for receiving the overflowing second material when the case lower portion is sunk into the case main body.

Effects of the Invention

According to the present invention described above, an ignition coil capable of outputting necessary ignition energy with high efficiency can be realized without increasing manufacturing costs. In addition, an ignition coil capable of maintaining reliable insulation performance over a long period can be realized.

BRIEF DESCRIPTION OF THE DRAWINGS

FIGS. 1A through 1F are views illustrating a step for attaching a secondary coil L2 to a case lower portion 20.

FIGS. 2A through 2E are views illustrating a step for integrating the secondary coil L2 with the case lower portion 20.

FIGS. 3A through 3E are views illustrating a step for positioning a center core Co1 and a primary coil L1, and further positioning an outside core Co2.

FIGS. 4A through 4E are views illustrating an igniter assembly DEV.

FIGS. 5A through 5D are views illustrating an inner configuration and connection terminals of the igniter assembly DEV.

FIGS. 6A through 6E are views illustrating a step for housing the igniter assembly DEV into a coil main body unit BDY.

BEST MODES FOR CARRYING OUT THE INVENTION

Figures 4C, 4D, 4E:
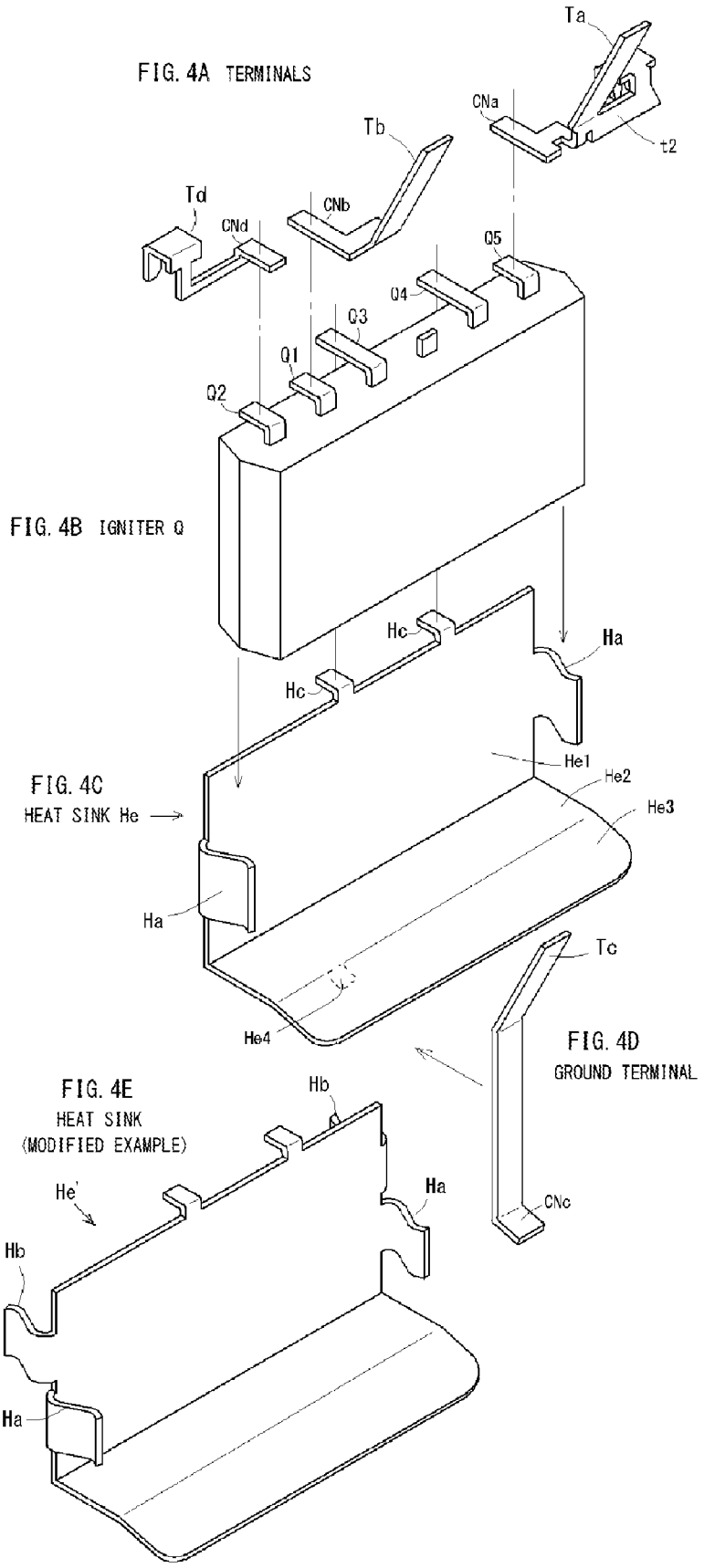

The present invention is hereinafter described in more detail based on an embodiment depicted in FIGS. 1A through 6E. A general configuration is initially described with reference to a perspective view (FIG. 6E) illustrating an ignition coil 1 in a completed state. The ignition coil 1 according to the embodiment generally has a substantially T shape configured by a projecting shaft unit PR inserted into a plug hole, and a coil main body unit BDY disposed above the plug hole. These units PR and BDY are integrated into one piece body.

The ignition coil 1 includes an ignition circuit IGN illustrated in FIG. 5D. The ignition circuit IGN according to this embodiment includes a primary coil L1 and a secondary coil L2 electromagnetically coupled with each other, a switching element (igniter) Q for controlling on-off of a primary current of the primary coil L1, and a diode D for preventing a reverse discharge.

As schematically illustrated in FIG. 1F, an output voltage from the secondary coil L2 is transmitted to a high-voltage terminal OUT via a conductive terminal TR, and further transmitted to an ignition plug PG via a conductive spring SP housed in the projecting shaft unit PR. Each of the conductive terminal TR and the conductive spring SP has appropriate elastic force sufficient for realizing reliable electric connection with the high-voltage terminal OUT.

According to this embodiment, the igniter Q is configured by an IGBT (Insulated Gate Bipolar Transistor), for example. A heat sink He is disposed close to the igniter Q to effectively radiate heat from the igniter Q. As illustrated in FIG. 5D, an emitter terminal Q3 of the igniter Q is connected with a ground GND of an external circuit such as an ECU (Engine Control Unit) via the heat sink He and a connection terminal Tc. The heat sink He is constituted by a material having excellent heat conductivity, and has a sufficiently wide heat radiation area to effectively contribute to a high-output and high-speed ignition action.

A gate terminal Q1 of the igniter Q receives an ignition pulse SG via a connection terminal (signal terminal) Tb, while a collector terminal Q2 receives a battery voltage VB via the primary coil L1 and a connection terminal (power source terminal) Ta. The primary coil L1 and the secondary coil L2 are electromagnetically coupled with each other via a closed magnetic circuit formed by a center core Co1 and an outside core Co2.

According to this embodiment, the igniter Q, the heat sink He, the three connection terminals Ta through Tc, and a connection terminal Td connecting with the primary coil L1 and the like are integrated into one-piece body of an igniter assembly DEV beforehand (see FIGS. 5A through 5C). The connection terminals Ta through Tc are positioned on a coil case (case main body 10) by housing of the igniter assembly DEV illustrated in FIGS. 5A through 5C into the coil main body unit BDY.

According to the configuration of this embodiment, therefore, a sufficient work space is not required for electric connection of the connection terminals Ta through Tc within the coil case. Accordingly, size reduction of the coil case can be achieved from this viewpoint.

As can be seen from FIGS. 6A through 6D, the coil main body unit BDY made of a synthetic resin is roughly divided into the box-shaped case main body 10 for housing the ignition circuit IGN, and a case lower portion 20 for closing an opening of the case main body 10. The case main body 10 is segmented into a circuit housing portion 11 for housing the ignition circuit IGN, a fixing portion 12 connected and fixed to an engine block, and a collective terminal portion 13 including the connection terminals Ta through Tc. According to this embodiment, these portions are manufactured as one-piece body by resin molding. Accordingly, the necessity of a process for attaching the collective terminal portion 13 to the circuit housing portion 11 and the like is eliminated.

As illustrated in FIG. 6C, a filling opening 14 is formed below the collective terminal portion 13 to provide a thermosetting resin filling path. According to this embodiment, the filling opening 14 also functions as a passage for a heat sink He3 for projection from the igniter assembly DEV. More specifically, in a state that the igniter assembly DEV is attached to the coil main body unit BDY as illustrated in FIG. 6A', the extension portion He3 of the heat sink He is exposed from the coil main body unit BDY. The extension portion He3 elastically comes into contact with the engine block to realize frame grounding connection and increase radiation performance.

As illustrated in FIG. 6D and FIG. 1C, the case lower portion 20 is segmented into a bottom plate 21 for closing the perimeter of the case main body 10 of the coil main body unit BDY, and a connection portion 22 projecting from the bottom plate 21 to receive the projecting shaft unit PR. Provided on the bottom plate 21 are attachment flanges 23 for receiving and holding the secondary coil L2 and further receiving a protective cap 42, and fixing flanges 24 used for fixing the case main body 10 to the case lower portion 20. The bottom plate 21 further includes an opening H1 for securing a passage of a high-voltage conductive unit from the secondary coil L2 to the ignition plug PG.

In correspondence with this configuration of the case lower portion 20, the projecting shaft unit PR includes a base end portion 30 made of elastomer and fitted onto the connection portion 22 to prevent entrance of water into the plug hole, a cylindrical portion 31 included in the base end portion 30, and a tip portion 32 made of elastomer and covering the ignition plug PG as illustrated in FIG. 6E. The coil-shaped conductive spring SP is inserted into the cylindrical portion 31 to realize conduction of a high voltage output from the secondary coil L2 to the ignition plug PG.

Described hereinafter are procedures for manufacturing the ignition coil 1 having the foregoing configuration. The procedures for manufacturing the ignition coil 1 generally include a first step for attaching the secondary coil L2 to the case lower portion 20, a second step for integrating the protective cap, the secondary coil L2, and the case lower portion 20, a third step for positioning the primary coil L1 including the center core Co1 on a secondary bobbin 40, a fourth step for positioning the outside core Co2 around the primary coil L1, a fifth step for housing the igniter assembly DEV into the coil main body unit BDY, and a sixth step for filling a thermosetting resin in the coil case and hardening the resin.

<First Step for Attaching Secondary Coil L2 to Case Lower Portion 20>

FIGS. 1A through 1F are views illustrating the step for attaching the secondary coil L2 to the bottom plate 21 of the coil case. The secondary coil L2 includes the secondary bobbin 40 which has a rectangular hole H2 for receiving the primary coil L1, a secondary winding 41 wound around the secondary bobbin 40, and the protective cap 42 having electric insulation properties and tightly covering an upper part of the secondary bobbin 40. For convenience of drawing, the secondary winding 41 is not shown in FIGS. 1A through 1F. However, the secondary winding 41 having a turn number corresponding to a necessary high-voltage output is wound between respective sectioning flanges FG provided on the secondary bobbin 40.

A space occupied by the secondary bobbin 40 is defined by the perimeters of the sectioning flanges FG. This space is flared in a rounded shape from the base end side to the tip side in the axial direction, maintains the outside diameter of the flared shape, and slightly narrows the outside diameter on the tip side to form a substantially flared or substantially barrel-like contour shape as the whole.

This unique rounded contour shape of the secondary bobbin 40 in this embodiment contributes to size reduction of the ignition coil. A contour shape similar to the shape discussed herein may be produced by varying the number of windings of the secondary winding 41 by location.

The respective sectioning flanges FG of the secondary bobbin 40 are aligned in the axial direction. Each of the sectioning flanges FG has a notch CT. This notch CT serves as a filling path through which resin is injected in the subsequent integrating step, therefore the protective cap 42 can be attached to the secondary bobbin 40 in a state of the closest possible contact with the secondary bobbin 40. The close contact between the protective cap 42 and the secondary bobbin 40 increases the insulation performance of the secondary coil L2 while meeting the demand for size reduction of the ignition coil.

As illustrated in FIG. 1A, the protective cap 42 is a tunnel-shaped component having a shape corresponding to the contour shape of the secondary bobbin 40. More specifically, the protective cap 42 is flared in a rounded shape from the base end side to the tip side in the axial direction, and maintains the outside diameter of the flared shape to forma substantially tunnel shape as the whole. The tip side of the protective cap 42 is completely opened, while the base end side is opened with an opening slightly larger than the rectangular hole H2 and so configured as to be tightly attached to the base end surface of the secondary bobbin 40.

A cutout groove GV is formed in the inner surface of the upper part of the protective cap 42 in correspondence with the notches CT of the secondary bobbin 40. The cutout groove GV forms the resin path in cooperation with the notches CT of the secondary bobbin 40. According to this structure, resin is securely filled in a first gap 40A between the secondary winding 41 and the protection cap 42 even in a state of tight contact between the secondary bobbin 40 and the protection cap. As described above, the base end side of the protective cap 42 is tightly contact with the base end surface of the secondary bobbin 40. Accordingly, leakage of filling resin is avoidable.

A step portion BA is formed in the inner peripheral surface of the lowermost part of the protective cap 42. The step portion BA is fitted to the outer peripheral surface of the upper part of each of the attachment flanges 23. According to this structure, the step portion BA is fitted to the outer peripheral surface of the upper part of each of the attachment flanges 23 and stabilized thereon (FIG. 1E) when the protective cap 42 is attached to the attachment flanges 23 in a state that the secondary coil L2 is positioned on the case lower portion 20 as illustrated in FIG. 1D.

An adhesive may be applied to the step portion BA beforehand for fixing the protective cap 42 and the attachment flanges 23 in this stabilized state. However, it is preferable that the protective cap 42 and the attachment flanges 23 are integrated with each other by ultrasonic welding. In this case, the protective cap 42 and the attachment flanges 23 are formed into a one-piece structure having substantially no boundary surface when the protective cap 42 and the attachment flanges 23 are made of the same material.

In the attachment state illustrated in FIG. 1E, the output terminal of the secondary coil L2 is connected with the conductive terminal TR, and also electrically connected with the conductive spring SP via the conductive terminal TR and the high-voltage terminal OUT.

FIGS. 2A through 2D illustrate the coil main body unit BDY in a semi-complete state after completion of the first step.

In a preferable application example, the protective cap 42 may be extended and brought into direct contact with the case lower portion 20 to eliminate the attachment flanges 23. The protective cap 42 may be formed by a magnetic body. In this case, the protective cap 42 may be combined with the outside core Co2 to improve magnetic properties.

<Second Step for Integrating Secondary Coil L2 with Case Lower Portion 20>

After completion of attachment of the secondary coil L2 to the case lower portion 20, a thermosetting resin is injected (partially impregnated) into the protective cap 42 to fill a second gap 20A inside the protective cap 42 and thereby realize reliable electric insulation.

FIG. 2E is a view illustrating the second step, and showing a state where the thermosetting resin is injected into many semi-complete coil main body units BDY positioned in a work box, by using an injection nozzle lowered toward the work box under a deaerated condition of the work box.

As described above, the external size of the secondary bobbin 40 is substantially identical to the inner surface size of the protective cap 42, therefore only a narrow first gap 40A is produced therebetween. In this case, only a small amount of thermosetting resin is required for injection. Accordingly, the resin selected for use is a high-grade material having excellent insulation properties and excellent adhesive force for adhesion with the secondary winding 41 and the protective cap 42. However, the high-cost material thus selected does not particularly increase the manufacturing costs.

According to a work posture illustrated in FIG. 2E, the base end surface of the secondary bobbin 40 (lower end surface in FIG. 2E) is closed by the base end inner surface of the protective cap 42 in a breathable state. On the other hand, the injection resin has appropriate viscosity. Accordingly, the injection resin does not leak from the secondary bobbin 40. An opening H1 of the bottom plate 21 is closed by the high-voltage terminal OUT disposed on the connection portion 22. The work box is deaerated downward. Accordingly, the resin does not enter the inside of the opening H1.

Under these conditions, the process for hardening the thermosetting resin by heating is executed in the second step. For realizing this heating process rapidly and reliably, the heating process according to this embodiment is executed in a state of supply of an appropriate heating current to the secondary winding 41. Accordingly, the thermosetting resin is effectively heated from the inside and the outside to achieve a rapid and reliable heating process.

<Third Step for Positioning Center Core Co1 and Primary Coil L1>

Executed after completion of the second step is the third step for positioning the primary coil L1 including the center core Co1 on the secondary bobbin 40.

As illustrated in FIG. 3A, the primary coil L1 is configured by a primary bobbin 50 and a primary winding 51 wound around the primary bobbin 50. A winding start 51*a* and a winding end 51*b* of the primary winding 51 are wound around winding terminals La and Lb, respectively, in a state that conductors of the winding start and end 51*a* and 51*b* are exposed (FIG. 3D). FIG. 3A does not show the primary winding 51 for convenience.

After wound around the outer periphery of the primary bobbin 50, the primary winding 51 is further wound around the winding terminals La and Lb to complete the primary coil L1. Then, the center core Co1 is inserted into an inner opening 52 of the primary bobbin 50 (see FIG. 3B). The primary coil L1 in this state is inserted into the secondary bobbin 40 produced after the second step (see FIG. 3C).

<Fourth Step for Positioning Outside Core Co2>

Subsequently, the outside core Co2 is positioned in an annular shape such that the outside of the protective cap 42 is covered by the outside core Co2. The outside core Co2 generally having an annular shape is divided at an appropriate position into two parts, for example (see FIG. 3E). In this case, a closed magnetic circuit is formed by the outside core Co2 and the center core Co1 without producing an unnecessary space regardless of the number of divisions of the outside core Co2 (see FIG. 3E).

<Fifth Step for Housing Igniter Assembly DEV into Coil Main Body Unit BDY>

Thereafter, the igniter assembly DEV is housed into the coil main body unit BDY. Before describing this process, details of the igniter assembly DEV are touched upon herein. FIGS. 4A through 4E illustrate constituent elements of the igniter assembly DEV, showing the three connection terminals Ta through Tc connected with an external circuit, the connection terminal Td for connecting the collector terminal Q2 to the primary coil L1, the igniter Q including the IGBT, and the heat sink He. The completed state of the igniter assembly DEV is illustrated in FIGS. 5A through 5C, while electric connections of the respective parts of the igniter assembly DEV are illustrated in FIG. 5D.

As illustrated in FIG. 4A, the connection terminal Ta receiving the battery voltage VB includes a connection piece CNa for connection with the igniter Q, a receiving portion t1 for receiving a diode D (see FIG. 5A), a receiving portion La (see FIG. 5A) for receiving the winding terminal La (battery side) of the primary winding 51, a connection portion t2, and others. The connection terminal Ta is formed by bending a single plate, and connected with a connection terminal Q5 of the igniter Q via the connection piece CNa. However, the connection terminal Ta is electrically insulated from an internal circuit of the igniter Q (see FIG. 5D).

The connection terminal Tb receiving the ignition pulse SG is similarly formed by bending a single plate, and connected with the connection terminal Q1 of the igniter Q via the connection piece CNb. Electric connection between the connection terminal Tb and the gate terminal Q1 of the igniter Q is realized via the connection piece CNb.

As illustrated in FIG. 4D, the connection terminal Tc which is a ground terminal includes a connection piece CNc at a distal end of the connection terminal Tc. The connection piece CNc is electrically connected with the heat sink He to set the heat sink He at a ground potential. The heat sink He according to this embodiment is exposed from the coil case and brought into elastic contact with the engine block, as will be described below.

As illustrated in FIG. 4A, the connection terminal Td is similarly formed by bending a single plate, and includes a connection piece CNd connecting with the connection terminal Q2 of the igniter Q, and a receiving portion Lb (FIG. 5A) for receiving the winding terminal Lb (igniter side) of the primary winding 51. The connection piece CNd is connected with the connection terminal Q2 of the igniter Q to realize electric connection between the primary coil L1 and the collector terminal Q2 of the igniter Q.

As illustrated in the drawings, the igniter Q includes six exposed connection terminals including not used terminals. Connection terminals Q3 and Q4 of these terminals are exposed long and connected with the heat sink He, respectively, to obtain the same ground potential.

As illustrated in FIG. 4C, the heat sink He includes a vertical portion He1 which is in contact with the rear surface of the igniter Q, a horizontal portion He2 for receiving the bottom surface of the igniter Q, an extension portion He3 continuing from the horizontal portion He2 while bending, a connection portion He4 for connecting with the connection terminal Tc, holding portions Ha for holding the side surfaces of the igniter Q, and connection portions Hc connecting with the connection terminals Q3 and Q4 of the igniter Q.

The igniter Q is lowered as indicated by arrows to be held on the heat sink He. In this state, the connection terminals Ta, Tb, and Td are connected with the connection terminals Q5, Q1, and Q2 of the igniter Q, respectively, by welding or other methods. The connection piece CNc of the connection terminal Tc is connected with the connection portion He4 of the heat sink He. After these processes, the igniter assembly DEV comes into a completed state.

According to a conventional ignition coil, a process for connecting the connection terminals Ta through Td is needed after the igniter Q in the state illustrated in FIG. 4B is positioned on the coil case. According to this embodiment, however, the igniter assembly DEV in the completed state after connection of the connection terminals Ta through Td is prepared beforehand. In this case, the necessity of a complicated connection process for the coil case, and the necessity of a sufficient work space within the coil case are both eliminated.

FIGS. 4A through 4D are views illustrating an example of the coil case including only the ignition circuit IGN. However, in a preferable application example, the coil case may include an ion detection circuit in addition to the ignition circuit IGN. In this case, a structure of a heat sink He' illustrated in FIG. 4E is adopted. The igniter Q and the ion detection circuit are held by holding portions Ha and Hb, respectively, via the vertical portion He1. In addition, an output terminal for outputting an ion detection signal is provided as an additional connection terminal projecting from the collective terminal portion 13.

The ion detection circuit in this context is a circuit for detecting an ion signal generated from an engine combustion chamber at the time of combustion. The ion detection circuit is a circuit for rapidly detecting knocking, or realizing optimum combustion control to achieve exhaust gas reduction, fuel consumption reduction and others.

As illustrated in FIG. 6A, the igniter assembly DEV, which has been discussed in this embodiment and the modified example, in the completed state is assembled from the lower side of the case main body 10. In this case, the three connection terminals Ta through Tc penetrate a passage groove formed in the collective terminal portion 13, and come into an exposed state in an oblique direction toward the right in FIG. 6A.

The extension portion He3 configuring the heat sink He passes through the filling opening 14 and comes into an exposed state from the case main body 10 (see FIG. 6A').

<Sixth Step for Filling and Hardening Thermosetting Resin>

Finally, the case main body 10 in the state illustrated in FIG. 6A' is integrated with the case lower portion 20, and housed into a vacuum box. For integrating the case main body 10 with the case lower portion 20, the fixing flanges 24 (FIG. 1C) of the case lower portion 20 are utilized.

After integration of the case main body 10 with the case lower portion 20, electric connection between the power source terminal Ta, the primary coil L1, and the diode D is realized by engagement contact between the receiving portions t1 and La (see FIG. 5A through 5C) of the power source terminal Ta and the winding terminal La of the primary coil L1.

In addition, electric connection between the primary coil L1 and the igniter Q (collector terminal Q2) is realized by engagement contact between the receiving portion Lb of the connection terminal Td (FIG. 5A through 5C) and the winding terminal Lb of the primary coil L1.

The thermosetting resin is filled in the gap of the case main body 10 in the vacuum box under an appropriate decompression condition, and heated and hardened to secure reliable electric insulation properties. As described above, the filling opening 14 is used as a filling path for the thermosetting resin.

According to this embodiment, the thermosetting resin to be adopted has not only electric insulation properties, but also excellent thermal conductivity. Accordingly, heat generated from the igniter Q is radiated not only via the heat sink He, but also through the filling resin to secure stable operation of the ignition circuit IGN.

The process for filling resin may be executed by using a method (overflow method) other than the foregoing method. In this case, however, the filling opening 14 needs to be closed, with an appropriate gap formed below the collective terminal portion 13 to receive liquid. FIGS. 7A through 7D are views illustrating this overflow method, showing a liquid receiving pocket PK formed below (or above in FIG. 7A) the collective terminal portion 13. The igniter assembly DEV is disposed on the left side of the liquid receiving pocket PK. A liquid passage hole He5 is formed in a lower portion (or upper portion in assembled state) of the heat sink He which has the slightly higher vertical portion He1. This structure securely forms an overflow path (see FIG. 7D).

According to this embodiment, a heating body 60 having a shape substantially similar to the shape of the case main body 10 is prepared. The thermosetting resin is filled in a state that the case main body 10 is positioned on the heating body 60. In this case, the amount of injection is determined such that an overflow amount to be produced later becomes substantially minimum.

Figure 7A:
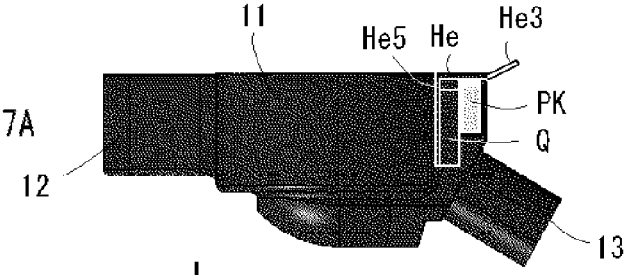
FIGS. 7A through 7D are views illustrating a step for filling and hardening a thermosetting resin.
Figure 7B:
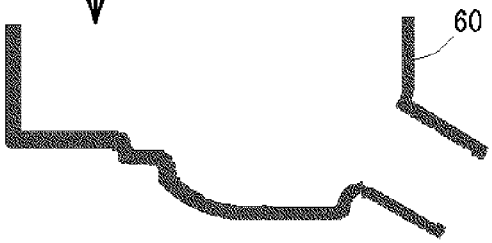
Figure 7C:
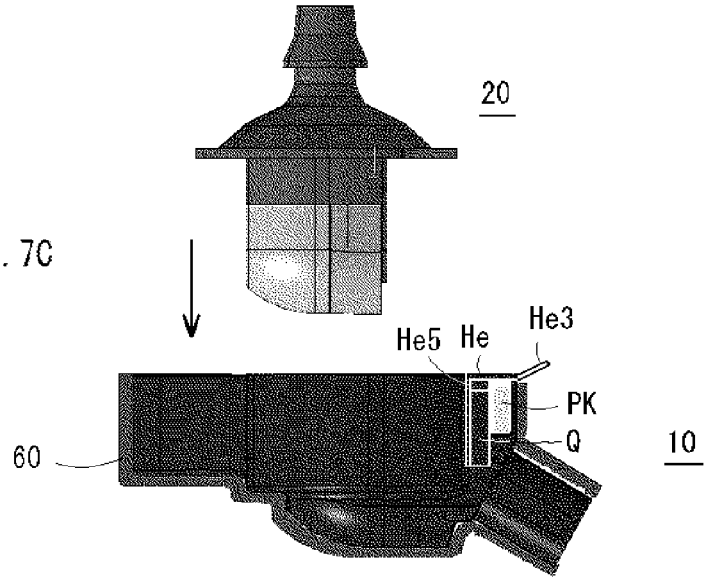
Figure 7D:
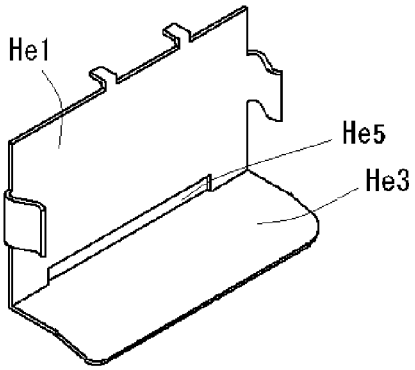

Thereafter, the case lower portion 20 is lowered from the upper side of the case main body 10 in a state that the primary coil L1 and the secondary coil L2, and the cores Co1 and Co2 have been attached to the case lower portion 20 (FIG. 7C does not illustrate an accurate state). As a result, a thermosetting resin having overflowed passes through the liquid passage hole He5 and shifts toward the liquid receiving pocket PK.

Then, the heating body 60 is operated to harden the filling resin. These processes are executed under an appropriate decompression condition as necessary. According to this embodiment, the filling resin is used without producing a loss of material. Moreover, the filling and hardening step finishes in a short time. Furthermore, filling in the portion around the coil winding 41 of the secondary coil L2 has been completed beforehand, therefore no problem occurs even when the sixth step is executed in a simplified manner.

The present invention is not limited to the embodiment specifically described herein, but may be practiced otherwise in appropriate manners.

The invention claimed is:

1. An ignition coil comprising:

a coil main body unit that houses a primary coil and a secondary coil electromagnetically coupled with each other, and a switching element that controls on-off of a current of the primary coil; and a projecting shaft unit that projects in a first direction from the coil main body unit, wherein a case of the coil main body unit includes a case main body having a box-shaped housing space, open to the projecting shaft unit, and a case lower for holding the primary and secondary coils and for closing the housing space by contacting a perimeter of the main body, and wherein the secondary coil has a secondary bobbin including the primary coil within a central hole penetrating the secondary bobbin in a second direction, and the secondary coil is covered partially by the case lower portion and a protective cap, while a first gap between the secondary bobbin and an inner surface of the protective cap contains a first insulation material, and wherein a second gap remaining in the housing space closed by the case lower portion contains a second insulation material.

2. The ignition coil according to claim 1, wherein properties of the first material and the second material are different from each other in electric insulation and/or thermal conductivity.

3. The ignition coil according to claim 1, wherein a plurality of sectioning flanges are provided on the secondary bobbin at positions separated from each other in the second direction, in which condition the secondary winding is wound between the sectioning flanges, and each of the sectioning flanges includes a notch which serves as an injection path for the first material.

4. The ignition coil according to claim 3, wherein a cutout groove is formed in an inner periphery of the protective cap in correspondence with the notches.

5. The ignition coil according to claim 1, wherein the secondary bobbin has not a uniform external size in the second direction, but a flared or barrel-like rounded shape.

6. The ignition coil according to claim 5, wherein an inside diameter size of the protective cap is determined such that a rounded shape is formed in the second direction in correspondence with the external size of the secondary bobbin, with a base end side of the secondary bobbin closed by the protective cap by abutment between the base end side of the secondary bobbin and the protective cap, and with a tip side of the secondary bobbin opened through a gap between the tip end side of the secondary bobbin and an inner surface of the protective cap.

7. The ignition coil according to claim 1, wherein the case lower portion, to which the primary and secondary coils and the protective cap are fixed, is sunk into the case main body that has the housing space opened upward, in a state that the case main body is filled with an appropriate amount of the second material, to fill the gap of the housing space.

* * * * *